US005265539A

United States Patent [19]

Kurschner et al.

[11] Patent Number: 5,265,539

[45] Date of Patent: Nov. 30, 1993

[54] MAGNETIC SENSOR ARMING APPARATUS AND METHOD FOR AN EXPLOSIVE PROJECTILE

[75] Inventors: Dennis L. Kurschner, Minnetonka; Gregory F. Filo, Rogers, both of Minn.

[73] Assignee: Alliant Techsystems Inc., Edina, Minn.

[21] Appl. No.: 901,392

[22] Filed: Jun. 19, 1992

[51] Int. Cl.[5] ..... F42C 11/04; F42C 15/40; F42C 17/04

[52] U.S. Cl. ..... 102/206; 89/6.5; 102/209

[58] Field of Search ..... 89/6, 6.5; 102/209, 102/206, 200, 520, 521, 522, 201, 221

[56] References Cited

U.S. PATENT DOCUMENTS

| | | | |
|---|---|---|---|
| 3,417,700 | 12/1968 | Furlani | 102/209 |
| 4,080,869 | 3/1978 | Karayannis et al. | 89/6.5 |
| 4,603,635 | 8/1986 | Boudreau | 102/209 |
| 4,955,279 | 9/1990 | Nahrwold | 89/6.5 |
| 5,078,051 | 1/1992 | Amundson | 102/206 |

OTHER PUBLICATIONS

Alliant Technology, "Introduction of the XM744 Fuze".

Alliant Technology, "Military Specification: Fuze, PIBD, XM740, Second Environment Sensor For" (1984).

Campagnuolo et al., "Induction Sensor to Provide Second Environmental Signature for Safing and Arming a Non-spin-Projectile Fuze" (1984).

*Primary Examiner*—David H. Brown

*Attorney, Agent, or Firm*—Merchant, Gould, Smith, Edell, Welter & Schmidt

[57] ABSTRACT

A dipole magnet is placed in a sabot of an explosive projectile. The magnet is arranged and configured within the interior surface of the sabot—such that when the sabot is placed over the casing of the projectile, the majority of the magnetic flux tends to take a path through the projectile casing and between two sensing coils located within the fuze and within the projectile. The first sensing coil forms a larger circle which encompasses the aft end or outer diameter of the projectile which is made up of ferrous materials. The second sensing coil forms a smaller concentric circle (relative to the first sensing coil) and is situated inside the inner diameter of the after end of the projectile, thus encompassing no ferrous metal. The majority of the flux from the magnet enters the ferrous projectile casing, travels through the casing, and exits primarily between the two coils on a continuous path back to the magnet. In operation, as the sabot moves away from the casing after exit from the bore, the magnet also moves away. The result is that a change in the amount of flux flowing between the coils occurs. The change in flux moving between the two coils of wire creates a voltage that can be used to detect the sabot release. The second sensing coil is utilized to produce a gradiometer sensor. The output from the first and second sensing coils is provided to a summing block, the output of which is provided to a preamp/signal conditioning block. After the signal has been conditioned, the signals are provided to a differentiator and then to a threshold detector for subsequent transmission to the fuze logic.

21 Claims, 7 Drawing Sheets

FIG. 7
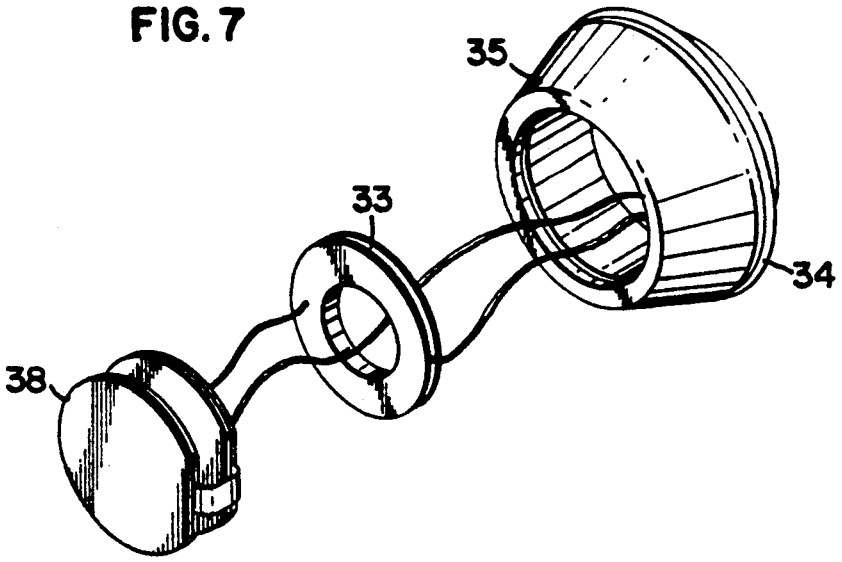
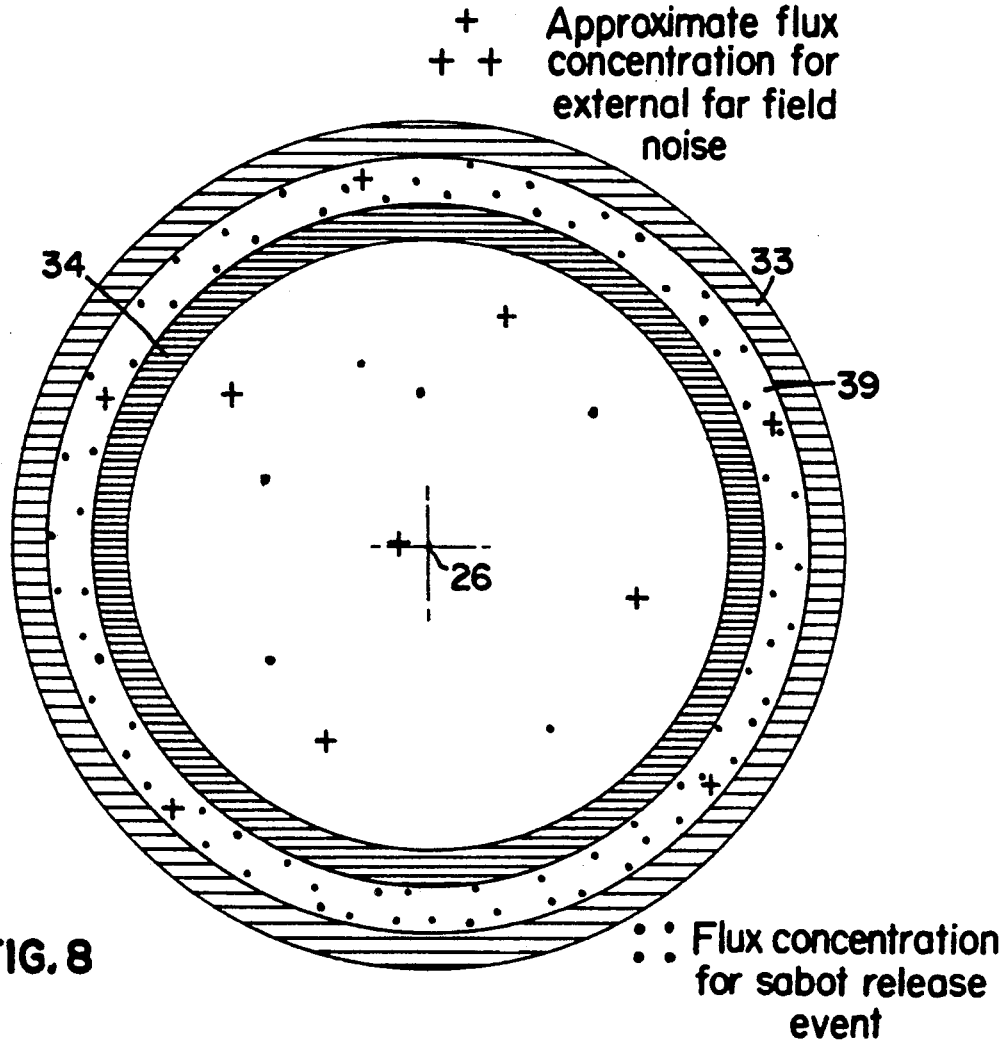
FIG. 8

MAGNETIC SENSOR ARMING APPARATUS AND METHOD FOR AN EXPLOSIVE PROJECTILE

FIELD OF THE INVENTION

This invention relates generally to a fuze device for an explosive projectile, and more particularly to a second environment sensor apparatus for automatically detecting changed magnetic flux levels corresponding to the projectile leaving the bore subsequent to firing in order to maintain fuze system safety and for initiating the timing for subsequent fuze functions.

BACKGROUND OF THE INVENTION

Fuzes employed in explosive projectiles use many different design criteria in order to preclude prematurely arming or detonating the explosive due to spurious or other non-firing events. For example, two sensed independent physical environments, which are directly associated with the launch cycle, must have changed before the explosive projectile is allowed to become armed. For the purposes of this application, the term "armed" will be given its usual meaning which is well known to those of ordinary skill in the art. Briefly, however, the process of "arming" means that one or more certain predetermined events have occurred which allows for the enabling of the fuze function.

As those skilled in the art will appreciate, the two changed independent physical environments are commonly referred to as a "first environment" and a "second environment." Such environments generally relate to the sensing of objective physical conditions which cannot be duplicated except through firing the explosive projectile. Thus, the sensed environments must represent significant changes from the ambient conditions under which the projectile is manufactured, handled, transported, stored, and loaded for firing in order to ensure compliance with the proper safety considerations.

Oftentimes, the first environment which is sensed represents an actual firing event—such as the setback inertial force on the fuze caused by the forward acceleration of the projectile within the bore. Since the first environment relates to an event which occurs upon firing, it is desireable that the second environment represents the actual exit of the projectile from the bore in order to ensure in-bore safety (i.e., it is desireable to insure that there is no possibility of arming the fuze with subsequent initiation of the explosive train within the bore).

In the past, second environments which were sensed included set-forward acceleration (i.e., based on the negative acceleration of the projectile due to air friction/drag), or a specified level of spin (i.e., based on the spin imparted on the projectile due to the rifling of the bore to promote in flight projectile stability). However, these methods have suffered from drawbacks such as requiring moving parts and other unreliable mechanical sensors. In addition, the actual sensed parameters of such selected environments may suffer from varying magnitudes over all the conditions encountered.

Further, the second environment mechanical sensing devices discussed above were not capable of reliably initiating the timing of fuze functions beginning with the exit of the projectile from the bore. Finally, with the advent of electronics' based fuzes, such systems did not provide a simple and reliable electronic or other non-mechanical sensor which could be utilized to further the evolution/maturation to the complete elimination of all moving parts in the fuze.

Many tank gun projectiles employ a sabot as an integral part of the round design. The sabot is typically comprised of three "petals" which fit together around the actual projectile to fill the space between the projectile and the gun tube. The sabot provides structural integrity and sealing functions during the firing of the round, and is thereafter discarded upon muzzle exit to minimize flight weight and drag. While the manner in which sabots are discarded is known in the art, a brief example will next be provided.

The petals of the sabot are pinned together (at the trailing edge) about the round. A band, such as nylon, is wrapped around the sabot petals to hold the petals against the housing. Typically, there are no physical connections between the sabot and the housing. The petals of the sabot form an air-scoop at or near the leading edge of the projectile. Upon firing the projectile, the band breaks due to the environment within the gun tube. As the projectile exits the tube, the air scoop entrains air such that the petals are lifted up and away from the housing. This action shears the pins at the trailing edge of the petals, and so the petals fall away from the round.

As just described, one of the events which occurs upon the projectile leaving the bore is that the sabot releases. Therefore, detecting the release of the sabot would enable a meaningful solution to second environment safety considerations and initiating further timing functions (i.e., since the sabot release indicates that the projectile is out of the bore, it also inherently provides a meaningful initial time reference for safe separation and other further functions of the projectile's fuze).

Although sensing the sabot release is desireable, there is a dilemma presented in detecting the presence or absence of the sabot either by mechanical means or by remotely located electrical means, such as a switch. More specifically, all such detection indications must be routed inside the fuze well and into the fuze itself from points external to the projectile. However, wires and other mechanisms leading from the fuze to the outside of the projectile body present problems in manufacture, assembly, test, and firing survival of the fuze and projectile, as well as posing in-bore safety problems if the round is not well sealed.

Therefore, there arises a need for a second environment sensor apparatus and method which is capable of reliably sensing a second environment condition change to ensure safety by precluding arming of the fuze throughout the mission life of the projectile up to and including the in-bore time of the launch cycle, preferably without use of mechanical means or remotely located electrical means. Further, there arises a need for a second environment sensor apparatus and method which is capable of accurately generating a signal corresponding to the sensed condition and to preferably utilize the sensed condition signal to initiate the timing of fuze functions. The present invention directly addresses and overcomes the shortcomings of the prior art.

SUMMARY OF THE INVENTION

The present invention provides a simple and reliable method and apparatus for sensing a changed second environment. Further, once the second environment is detected, the apparatus preferably generates a sensed condition status signal for receipt by the fuze electronics to initiate arming the projectile.

In a preferred embodiment constructed according to the principles of the present invention, a simple dipole magnet is placed in the sabot of an explosive projectile. The magnet is arranged and configured to lie parallel to the longitudinal axis of the explosive projectile. The longitudinal axis of the projectile is also parallel to the intended line of travel/flight of the projectile upon firing.

The magnet is embedded within the interior surface of the sabot—such that when the sabot is placed over the casing of the projectile, the majority of the magnetic flux tends to take a path through the projectile casing and between two sensing coils located within the fuze and within the projectile. The sensing coils are each preferably comprised of loops of wire which are oriented within the same plane and are wound in opposite directions. The first sensing coil forms a larger circle which encompasses the aft end or outer diameter of the projectile which is made up of ferrous materials. The second sensing coil forms a smaller concentric circle (relative to the first sensing coil) and is situated inside the inner diameter of the after end of the projectile, thus encompassing no ferrous metal. Accordingly, the location and orientation of the first and second sensing coils provides for a situation wherein the majority of the flux from the magnet enters the ferrous projectile casing, travels through the casing, and exits primarily between the two coils on a continuous path back to the magnet.

In operation, as the sabot moves away from the casing after exit from the bore, the magnet also moves away. The result is that a change in the amount of flux flowing between the coils occurs since virtually all of the flux passes within the circumference of the outer coil, but outside the circumference of the inner coil. In fact, the change in flux moving between the two coils of wire will create a voltage that can be used to detect the sabot release.

However, since it is also possible for other extraneous events to generate time changing flux levels, a feature of the preferred embodiment of the present invention is that a second smaller sensing coil is utilized to produce a gradiometer sensor. By using the difference between the two coils, a change in the magnetic field strength between the two sensing coils produces a significant voltage which minimizes the possibility that far field or noise effects (i.e., events wherein the magnetic fields will be equivalent to each other) will trigger the second environment sensor. Accordingly, the output from the first and second sensing coils is provided to a summing block, the output of which is provided to a preamp/signal conditioning block. After the signal has been conditioned, the signals are provided to a differentiator and then to a threshold detector for subsequent transmission to the fuze electronics.

One advantage of the present invention is that it is a very reliable second environment sensor and so adds to the design criteria for safety of the explosive projectile. By sensing the sabot release, it is by its very nature representative of the state of being outside the gun tube/bore.

Another feature of the present invention is that such a sabot release detection approach has no moving parts or linkage to the sabot which might affect projectile performance. As noted above, the device merely utilizes one dipole magnet in each sabot petal. Accordingly, magnetic interaction is utilized (which is subsequently eliminated upon sabot release outside of the bore). Further, no interconnections are necessary to sensors outside the fuze well and no alignments during assembly are required since the design concept is preferably axially symmetrical.

Yet another feature is that the magnetic interaction produces unique predetermined signatures allowing for robust determination of second environment events. Still further, the use of the second sensing coil provides sub-cancellation of external extraneous signals.

Therefore, according to one aspect of the invention, there is provided a second environment sensor for an exploding projectile, comprising:

(a) a magnet;

(b) a casing for the exploding projectile, wherein said casing includes materials conducive to magnetic flux;

(c) a first sensing means for sensing the magnetic flux from said magnet flowing in said casing, wherein said first sensing means is arranged and configured within said casing such that when said magnet moves away from said casing, a change in flux causes said first sensing means to generate a voltage whereby the removal of said magnet may be detected.

While the invention will be described with respect to a preferred embodiment circuit configuration and with respect to particular circuit components used therein, it will be understood that the invention is not to be construed as limited in any manner by either such circuit configurations or circuit components described herein. Further, while the preferred embodiment of the invention will be described in relation to an exploding projectile which is fired from a ferrous barrel having a bore, it will be understood that the scope of the invention is not to be limited to such environment. The principles of this invention apply to the detection of changes in the magnetic lines of flux subsequent to a firing sequence and in the generation of a signal to alert a safe and arm circuit of the sensed second environment. Finally, it should be understood that while the preferred example used herein relates to the sensed second environment, the sensed event could also comprise a sensed first or other numbered environment.

These and various other advantages and features which characterize the invention are pointed out with particularity in the claims annexed hereto and forming a part hereof. However, for a better understanding of the invention, its advantages and objectives obtained by its use, reference should be had to the drawing which forms a further part hereof and to the accompanying descriptive matter, in which there is illustrated and described a preferred embodiment to the invention.

BRIEF DESCRIPTION OF THE DRAWING

Referring to the drawing, wherein like numerals represent like parts throughout the several views:

FIG. 7 is a perspective view of the preferred winding arrangement of first and second sensors 33, 34; and FIG. 8 is a diagrammatic representation of the orientation and arrangement of first and second sensors 33, 34 with lines of flux 32 and longitudinal axis 26 illustrated as points to depict a third dimension coming out of the page.

DETAILED DESCRIPTION OF A PREFERRED EMBODIMENT

As mentioned above, the principles of this invention apply to the automatic detection of a second environment condition for an exploding projectile. The second environment sensor of the present invention provides for the detection of the second environment relating to exit from the gun barrel bore and simultaneously provides a timing reset function to enable the timing of events from exit from the bore. By way of example and not limitation, such event could include safe separation, among others.

Accordingly, this invention, in a sense, provides a second safety feature for precluding premature arming and/or initiation of the firing train while the projectile is within the barrel/bore. Additionally, this invention allows for subsequent timing sequences such as safe separation distances from the bore prior to arming and explosion. A preferred application for this invention is in the monitoring and determining of sabot release from a gun barrel in a tank-style weapon. Such application is typical of only one of innumerable types of applications in which the principles of the present invention can be employed.

Figure 1:
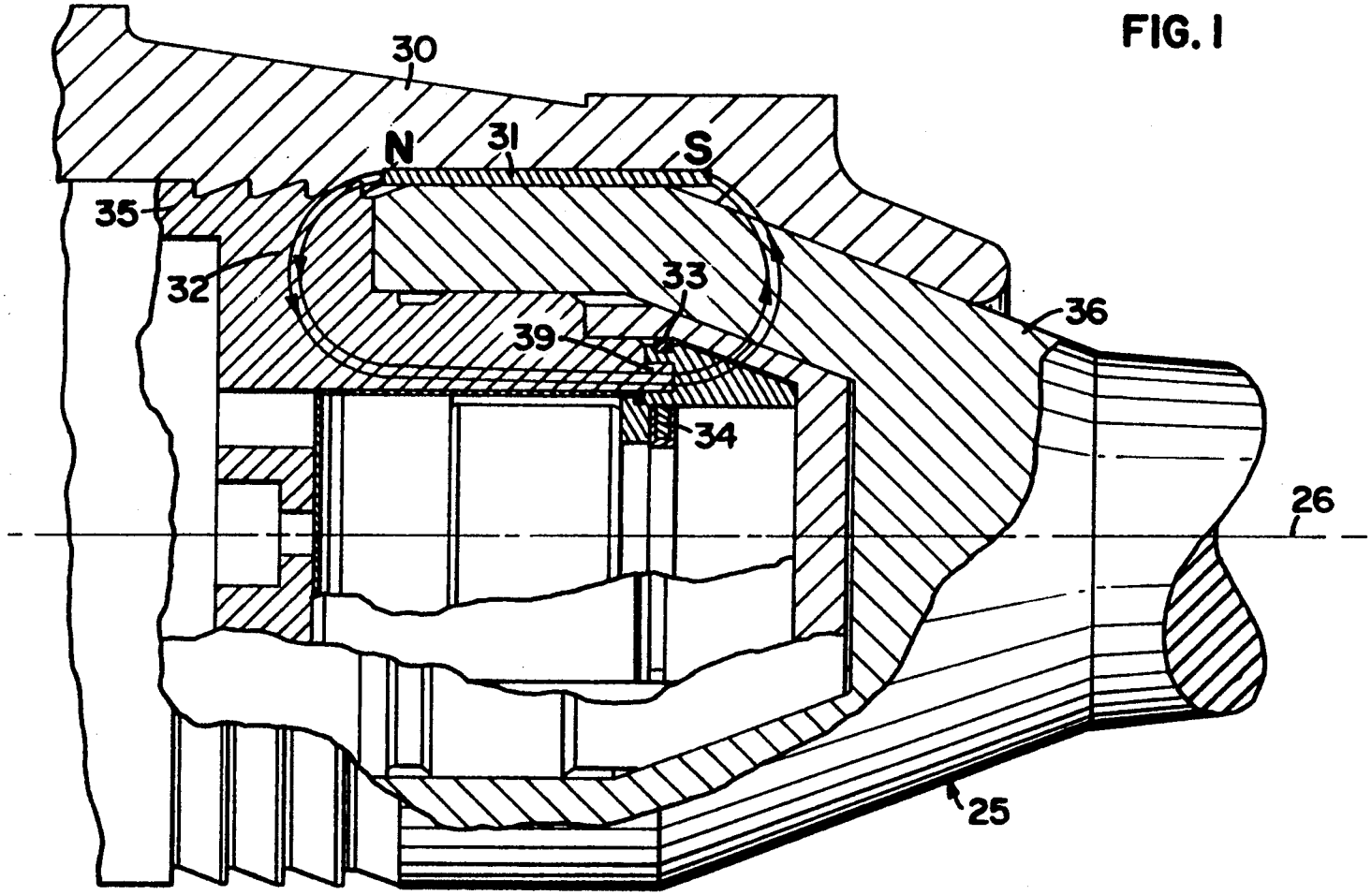
FIG. 1 is cross-sectional view of a portion of an exploding projectile with portions broken away.

Referring first to FIG. 1, there is illustrated portions of the sabot 30 as applied to the casing of an exploding projectile. The sabot 30 includes a magnet 31 oriented with its north and south poles generally parallel to the longitudinal axis of the projectile 25. For the purposes of clarity, the longitudinal axis is designated in FIG. 1 as 26. As noted above, the longitudinal axis of the projectile 25 is parallel to the intended flight path of the projectile 25.

A sabot 30 is often comprised of three matched petals. Accordingly, although only one magnet 31 is illustrated in the drawing, one or more magnets 31 may be utilized to practice the present invention. In fact, preferably, each sabot petal will include a magnet 31 to insure the geometrical symmetry of the invention (which reduces alignment concerns during assembly). The projectile 25 itself may be of many types, with a preferred type being manufactured by Alliant Techsystems Inc. of Minneapolis, Minn., assignee of the present invention, having a model number designation of M830Al. While those skilled in the art will appreciate and understand the operation of the exploding projectile 25, for further information reference should be had to copending applications titled "Electro-Mechanical Base Element Fuze", Ser. No. 07/901,381, the inventors being Gregory F. Filo, Dennis L. Kurschner, and Paul L. Weber, and "Gun Launched Non-Spinning Safety and Arming Mechanism", Ser. No. 07/901,113, the inventors being Paul L. Weber and Peter H. Van Sloan, both applications filed on Jun. 19, 1992 (concurrently herewith). Both of the foregoing applications are commonly assigned to the assignee of the present invention and are hereby incorporated herein by reference.

Still referring to FIG. 1, the lines of flux emanating from the magnet 31 are illustrated generally at 32. As those skilled in the art will appreciate, the flux 32 tends to travel through the lowest reluctance path from north to south poles of magnet 31. In this instance, the projectile body 35 of the projectile 25 is typically made of steel or other ferrous material. Accordingly, the main path(s) through which the lines of flux 32 will travel will be through the steel portion of the body 35 and then through the narrowest band of aluminum outer casing 36 of the projectile 25. Those skilled in the art will appreciate that the magnetic reluctance of aluminum is higher than steel.

Therefore, in this manner, the majority of the flux 32 from the magnet 31 prior to sabot 30 separation will generally travel between the first and second sensor coils designated as 33 and 34 respectively. Reference may be had to FIGS. 7 and 8 for further illustration of the orientation and arrangement of the sensor coils 33 and 34. Also illustrated in FIG. 7 is the electronics assembly 38 for the electronics (described further below) of the second environment sensor.

Since the fuze construction and projectile body lip 39 are designed such that the ferrous steel of the body 35 goes between the two coils (as shown in FIGS. 1 and 7), the placement of these elements causes the flux lines 32 from the magnet 31 to enter the steel body 35, travel through the steel, and exit primarily between the two coils 33, 34 on a continuous path back to the magnet 31.

Faraday's law states that the voltage produced in a coil of wire by impinging flux is:

$$V_c = -N(d\phi/dt) \quad (1)$$

where $V_c$ = induced voltage in coil

N = number of coil turns $\phi$ = total flux within coil t = time

If one envisions only the single outer coil 33 of FIG. 1, it is evident that the orientation and arrangement of the magnet 31 places the majority of the lines of flux 32 within the first sensing coil 33 in the static condition. When the magnet 31 moves away (i.e., at sabot 30 releases), the new flux level is much lower, and by the equation above, a voltage will be developed as follows:

$$V_c = -N((\phi_{final} - \phi_{initial})/(\Delta t_{final \rightarrow initial})) \quad (2)$$

This voltage might be used to detect the sabot 30 release assuming proper design of the coil and magnetic flux levels. However, it is possible for other extraneous events to also generate time changing flux levels during the mission of the fuze. Consequently, the second sensing coil 34 is preferably added, as illustrated in FIG. 1, to produce a gradiometer sensor. The two coils 33, 34 of the gradiometer are wound in opposition to produce:

$$V_c = N_1(d\phi_1/dt) - N_2(d\phi_2/dt) \quad (3)$$

Since the flux is equal to BA where B is the flux density of the field times the coil area A, the above equation can be written as:

$$V_c = (N_1 A_1 \Delta B_1 - N2A_2 \Delta B_2)/(\Delta t) \quad (4)$$

In the preferred embodiment, $N_1A_1 = N_2A_2$, resulting in:

$$V_c=(K(\Delta B_1-\Delta B_2))/(\Delta t) \quad (5)$$

which describes a "difference sensor."

It will be appreciated that for far field or noise effects, $B_1=B_2$ and no output will be generated. However, a significant voltage will be generated due to the sabot release influence. More specifically, since nearly all of the flux travels through the first sensing coil 33 (i.e., the outer coil due to the ferrous metal configuration) very little flux is able to enter the inner 34 or second sensing coil, and, therefore, $\Delta B_1-\Delta B_2$ produces a significant voltage.

Another useful characteristic of this design which may be appreciated upon a review of the above equations is the reaction sensitivity. The output voltage is directly proportional to the speed of the flux change—$\Delta t$. An accident or similar event where the sabot 30 may inadvertently be removed from the projectile is some 100 times slower in speed than the actual gunfire sabot discard event. The design parameters for the second environment sensor apparatus may be adjusted to be non-sensitive to anything other than an actual event, contributing significantly to the system's safety.

Figure 2:
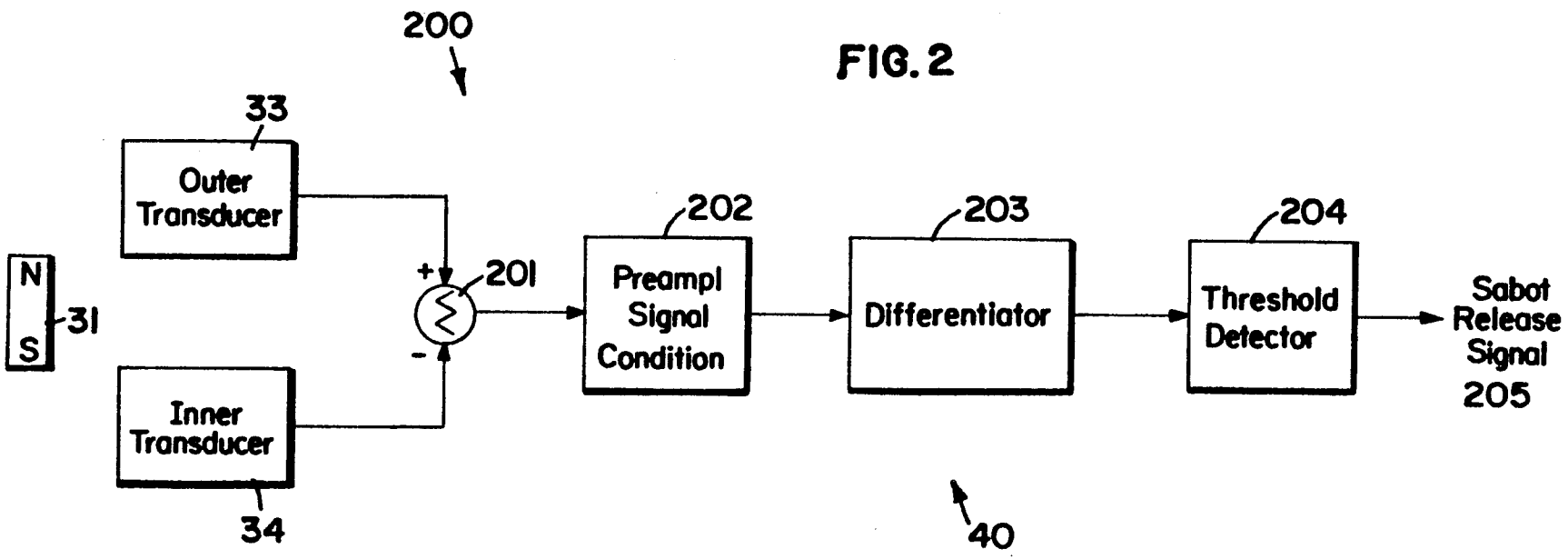
FIG. 2 is a schematic block diagram illustrating the various components of the second environment sensor of the present invention.
Figure 4:
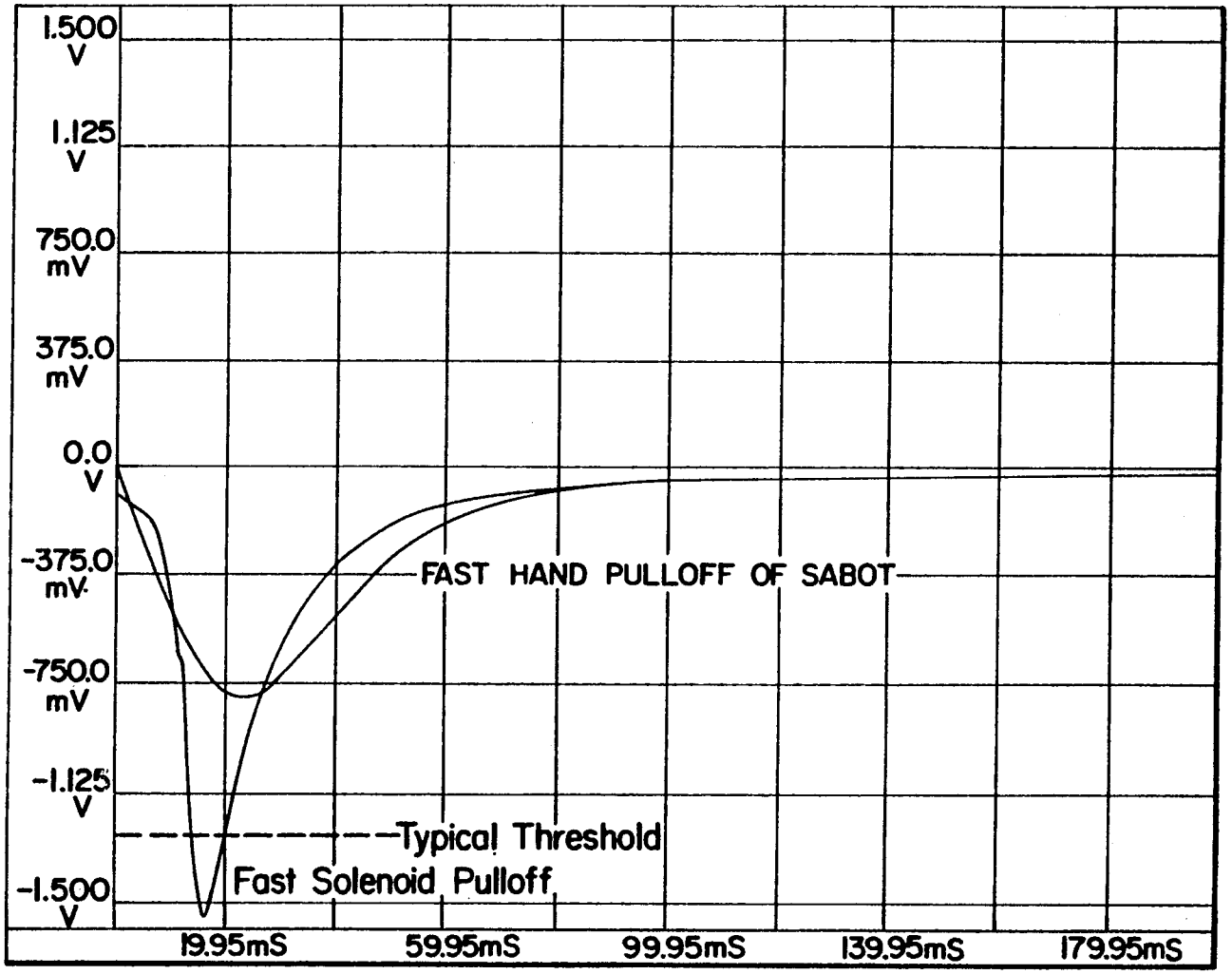
FIG. 4 is a graphical depiction of the voltage generated by various events using the present invention.

For example, FIG. 4 illustrates two wave forms obtained in laboratory tests from the output of the second environment sensor 40 (best seen in FIG. 2). The lowest peak wave form results from removing the sabot 30 by hand as fast as possible. A larger peak wave form is produced by a faster mechanical pull-off of the sabot 30. An actual gunfire event will produce a wave form of even significantly larger magnitude. As a result, a predetermined signature of the sabot 30 release may be determined which can be further utilized to ignore other spurious or non-firing events.

In order to appreciate the circuitry used to analyze the voltages produced by the first and second sensors 33, 34, reference should be had to FIG. 2. The second environment sensor is illustrated generally at 40. Here, it is also illustrated that the voltages produced by sensors 33, 34 are added at summation block 201 with the resultant voltage signal being provided to a preamp/signal condition block 202. Block 202 provides for noise reduction, bandwidth tailoring, and amplification to generate a high signal to noise ratio output.

The output of the signal condition block 202 is provided to a differentiator block 203. This block performs a true differentiation of the signal output of block 202. The differentiation function will accentuate fast risetime waveforms and attenuate slower risetime waveforms, providing further preference to the actual sabot release event when compared to other inadvertent events. The differentiator must have proper time constants tailored to the sabot release event.

The differentiated signal is then provided to a threshold detector block 204 to ensure that the dynamics of the rate of change of flux is high enough for that expected of the signature second environment event. If in fact the threshold detector is triggered at block 204, then a sabot release signal is generated at 205 which is provided to the projectile fuze electronics 41 (best seen in FIG. 6). The threshold must be set high enough to disregard nuisance signals and low enough to discern the proper event.

Figure 3:
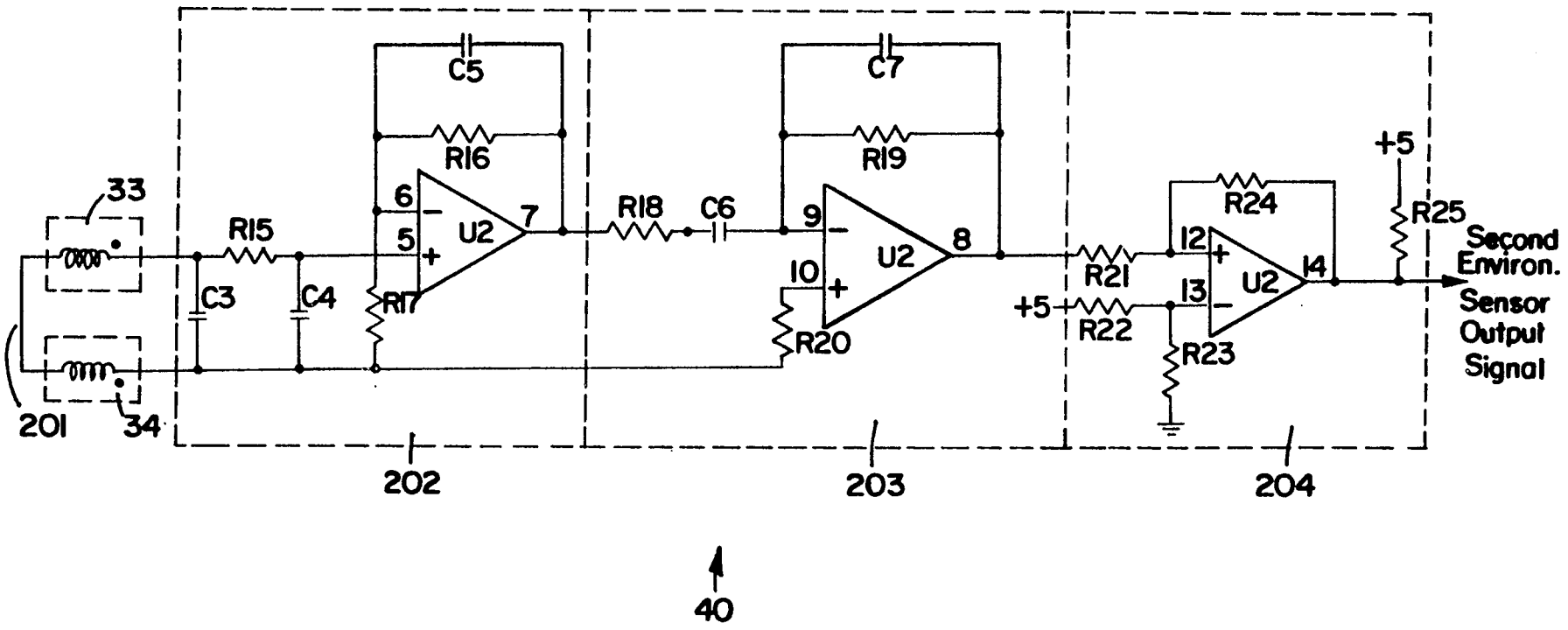
FIG. 3 is a third circuit implementation of the block diagram of FIG. 2.

Referring next to FIG. 3, a preferred embodiment circuit implementation of the block diagram discussed above is illustrated. It will be readily apparent to those of ordinary skill in the art how the respective functional blocks of FIG. 2 correspond to the various components in FIG. 3. Therefore, a detailed description will not be included herein, however, dotted lines have been provided around the various components in FIG. 3 to relate to the functional block diagram of FIG. 2. It will also be appreciated that other circuit implementations may be used while still practicing the principles of this invention.

Figure 6:
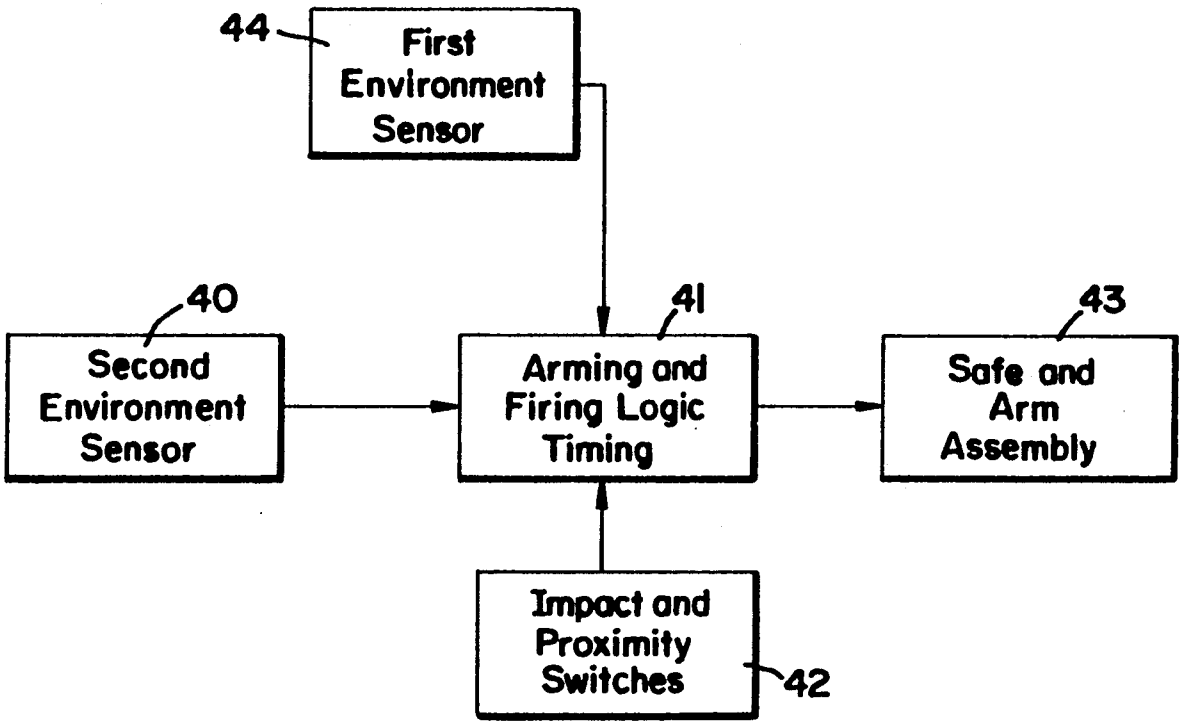
FIG. 6 is a block diagram illustrating the various components which may comprise the fuze electronics capable of receiving the second environment and timing signal from the second environment sensor apparatus of the present invention.

Referring next to FIG. 6, it is illustrated that the second environment sensor 40 provides a signal to the Arming and Firing Logic and Timing block 41 ("AFLT" block). This block performs the logical, timing, and other executive functions of the fuze. For example, AFLT block 41 performs safe separation function and sends the arming signals to the Safe and Arm Assembly block 43. The Impact and Proximity Switch block 42 provide detonation signals to the AFLT block 41. In operation, if all other logical conditions have been met, including receipt of a first and second environment sense signal from blocks 40 and 44, and upon receipt of a target generated detonation signal from block 42, the AFLT block 41 initiates the detonation of the projectile 25 via block 43.

It has been determined that only certain types of integrated circuit (IC) components are suitable for a tank projectile type of environment. In such an environment, the acceleration forces of the projectile often are on the order of 50,000–60,000 gravitational forces. Under such stresses certain types of IC's breakdown, for example high reliability military IC's packaged in ceramic fail due to a breaking of the internal bond wires. Additionally, the space/volume requirements are quite limiting in a fuze environment. Therefore, the IC size must also be taken into consideration. With these design criteria in mind, it has been found that plastic IC's, encapsulated with small form factors such as surface mount devices, and subsequent potting of the final electronic assembly are preferred to the more commonly used ceramic packages typical of high reliability integrated circuits for military applications.

ALTERNATIVE EMBODIMENT

Although the present invention has been described in relation to magnetic phenomena of the sabot 30 being released, wherein the sabot 30 carries an embedded magnet 31, alternatively full bore rounds may also utilize the principles of this invention. A full bore round refers to a projectile without a sabot. In this case, the same first and second sensing coil arrangement inside the fuze may be configured to sense the difference in the round's magnetic environment as between the levels inside the ferrous gun metal barrel (low level field) and those levels outside the barrel as the projectile exits. Those skilled in the art will appreciate that the outside fields are larger due to the earth's field ambience.

In either the first or the alternative embodiment, the detected event is integrated into the fuze logic as the second environment confirmation necessary to the total safe operation of the fuze. Similarly, the alternative embodiment also provides a reliable timing and initiation point to perform subsequent functions in the fuze as part of its overall operation. Further, in either embodiment, the electronics of the device are located in a fuze well cavity in the aft of the projectile body (best seen in FIG. 5). Preferably the magnetic sabot release sensor is one subsystem within an electronic fuze (best seen in FIG. 6).

Figure 5A:
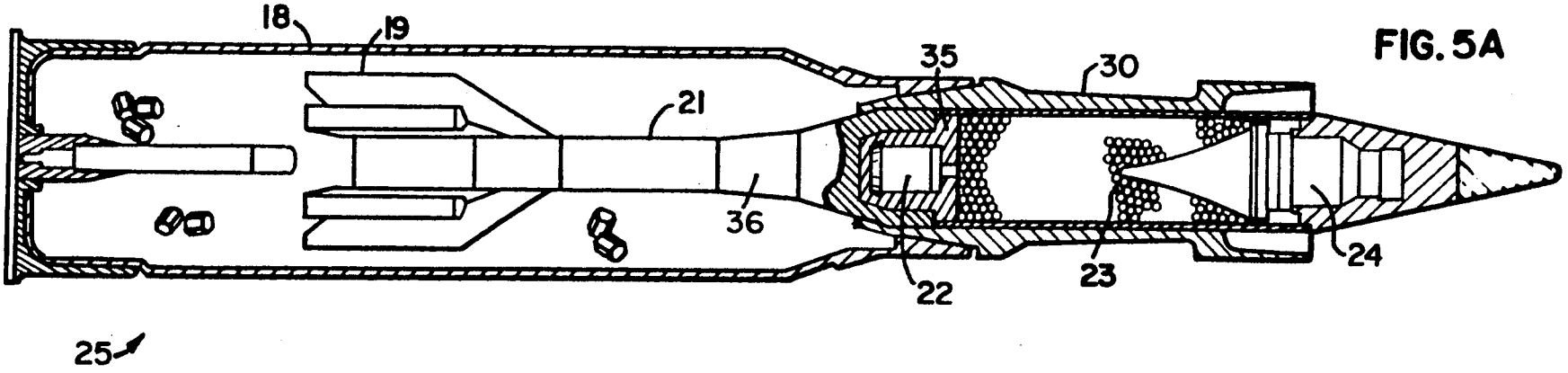
FIG. 5 is a diagrammatic representation of the exploding projectile of FIG. 1.
Figure 5C:
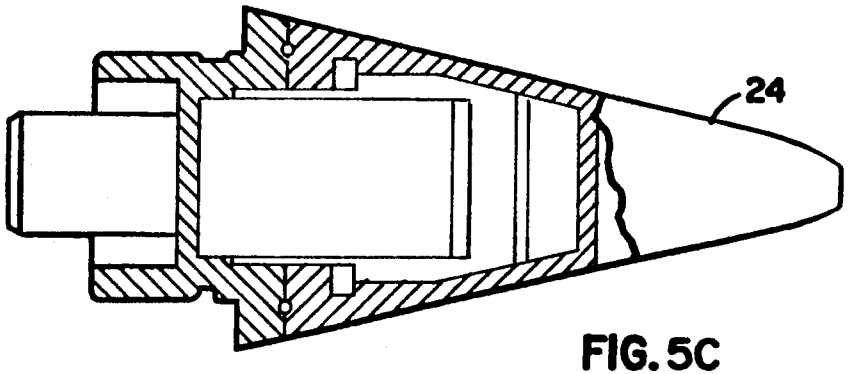
Figure 5B:
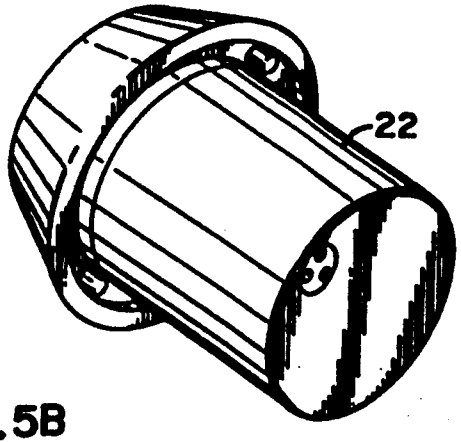

As illustrated in FIG. 5, the projectile 25 is mounted in a cartridge 18 for insertion into a launch tube such as a tank barrel (i.e., the breech end of the bore of a tank gun). The projectile 25 comprises a fin and tracer assembly 19 coupled through a fin adapter 21 to a body 23 containing a base element assembly 22. A sabot 30, described in more detail above, shrouds the projectile 25. At the frontal portion of the projectile 25 is disposed a nose cone 24 containing, inter alia, impact and proximity sensors 42.

While a particular embodiment of the invention has been described with respect to its application for monitoring specific signals from a second environment sensor, which senses the presence of a sabot and provides a sabot release signal to a fuze, it will be understood by those skilled in the art that the invention is not limited by such application or embodiment, or by the particular circuits disclosed and described herein. It will be similarly appreciated by those skilled in the art that other circuit configurations and applications other than as described herein can be configured within the spirit and intent of this invention. The circuit configuration described herein is provided as only one example of an embodiment that incorporates and practices the principles of this invention. Other modifications and alterations are well within the knowledge of those skilled in the art and are to be included within the broad scope of the appended claims.

What is claimed is:

1. An environment sensor apparatus for an exploding projectile of the type having a safe and arm mechanism, comprising:

(a) a magnet releasably connected to the exploding projectile;

(b) a casing for the exploding projectile, wherein said casing includes materials conducive to magnetic flux;

(c) a first sensing means for sensing the magnetic flux from said magnet flowing in said casing, wherein said first sensing means is arranged and configured within said casing such that when said magnet moves away from said casing, a change in flux causes said first sensing means to generate a voltage signal and provide the voltage signal to the safe and arm mechanism to indicate that a change has occurred in the sensed environment.

2. The environment sensor apparatus of claim 1, wherein said casing is constructed of a ferrous material.

3. The environment sensor apparatus of claim 2, wherein said material is steel.

4. An environment sensor apparatus for an exploding projectile, comprising:

(a) a magnet;

(b) a casing for the exploding projectile, wherein said casing includes materials conducive to magnetic flux;

(c) a first sensing means for sensing the magnetic flux from said magnet flowing in said casing, wherein said first sensing means is arranged and configured within said casing such that when said magnet moves away from said casing, a change in flux causes said first sensing means to generate a voltage whereby the removal of said magnet may be detected; and (d) second sensing means for sensing the change in magnetic flux, said second sensing means being arranged and configured so as to form a gradiometer device with respect to said first sensing means, whereby only removal of the magnet upon a firing of the projectile is detected.

5. The environment sensor of claim 4, wherein said first sensing means generates a first control signal and said second sensing means generates a second control signal, and further comprising threshold means for receiving said first and second control signals, for comparing said first and second control signals to a predetermined threshold, and for generating a release signal upon said comparison exceeding said predetermined threshold.

6. The environment sensor apparatus of claim 4, wherein said first sensing means is wound in a first direction in a circle the circumference of which encompasses the majority of the flux from said magnet moving within said casing, and wherein said second sensing means is wound in a second direction opposite of said first direction in a circle the circumference of which does not encompass the majority of the flux from said magnet moving within said casing.

7. The environment sensor of claim 6, wherein said first sensing means and said second sensing means form concentric circles lying within the same plane.

8. The environment sensor of claim 4, wherein said first sensing means generates a first control signal and said second sensing means generates a second control signal, and further comprising differentiator means for receiving said first and second control signals, differentiating said first and second control signals, and generating a differentiated signal, whereby fast risetime waveforms are accentuated and slower risetime waveforms are attenuated to provide further preference for actual magnetic movement events over other inadvertent events.

9. The environment sensor of claim 8, further comprising threshold means for receiving said differentiated signal, for comparing said differentiated signal to a predetermined threshold, and for generating a magnet movement signal upon said comparison exceeding said predetermined threshold.

10. The environment sensor of claim 9, wherein said magnet is arranged and configured within a sabot which enshrouds said casing of the projectile.

11. An environment sensor apparatus for an exploding projectile of the type having a safe and arm mechanism and used in a gun with a ferrous material barrel, comprising: sensing means for sensing the change in the magnetic flux from the Earth and other external sources, the change in the magnetic flux occurring from within the ferrous material barrel to external to the ferrous material barrel, wherein said sensing means is arranged and configured within the projectile such that when said projectile moves out of the barrel, a change in the amount of flux causes said sensing means to generate a voltage signal and provide the voltage signal to the safe and arm mechanism so as to indicate that a change has occurred in the sensed environment, whereby the projectile leaving the barrel can be detected.

12. The environment sensor apparatus of claim 11, wherein the sensing means comprises first and second sensing means for sensing the change in magnetic flux from the Earth and other external sources, the first and second sensing means being arranged and configured so as to form a gradiometer device, whereby the projectile leaving the barrel can be detected by from relative change in magnetic flux sensed by the first and second sensing means.

13. An environment sensor apparatus for an exploding projectile, of the type having a sabot which enshrouds the projectile and wherein portions of the projectile are comprised of ferrous materials, the sensor comprising:

(a) a magnet arranged and configured within the sabot, proximate the projectile; and (b) a first sensing means for sensing the magnetic flux from said magnet flowing in the ferrous materials of the projectile, wherein said first sensing means is arranged and configured within said casing such that when said magnet moves away from the projectile, a change in flux causes said first sensing means to generate a voltage whereby the removal of said magnet may be detected.

14. The environment sensor apparatus of claim 13, further comprising second sensing means for sensing the change in magnetic flux, said second sensing means being arranged and configured so as to form a gradiometer device with respect to said first sensing means, whereby only removal of the magnet upon a firing of the projectile is detected.

15. The environment sensor apparatus of claim 14, wherein said first sensing means is wound in a first direction in a circle the circumference of which encompasses the majority of the flux from said magnet moving within the projectile, and wherein said second sensing means is wound in a second direction opposite of said first direction in a circle the circumference of which does not encompass the majority of the flux from said magnet moving within the projectile.

16. The environment sensor of claim 15, wherein said first sensing means and said second sensing means form concentric circles lying within the same plane.

17. The environment sensor of claim 15, wherein said first sensing means generates a first control signal and said second sensing means generates a second control signal, and further comprising threshold means for receiving said first and second control signals, for comparing said first and second control signals to a predetermined threshold, and for generating a sabot release signal upon said comparison exceeding said predetermined threshold.

18. The environment sensor of claim 15, wherein said first sensing means generates a first control signal and said second sensing means generates a second control signal, and further comprising differentiator means for receiving said first and second control signals, differentiating said first and second control signals, and generating a differentiated signal, whereby fast risetime waveforms are accentuated and slower risetime waveforms are attenuated to provide further preference for actual sabot release events over other inadvertent events.

19. The environment sensor of claim 18, further comprising threshold means for receiving said differentiated signal, for comparing said differentiated signal to a predetermined threshold, and for generating a sabot release signal upon said comparison exceeding said predetermined threshold.

20. A method of detecting the sabot release from an exploding projectile subsequent to leaving the bore upon an actual firing event, the exploding projectile of the type having a sabot which enshrouds the projectile and wherein portions of the projectile are comprised of ferrous materials, the method comprising the steps of:

(a) sensing the magnetic flux from a magnet located in the sabot with a first sensing means; and (b) generating a voltage when the magnetic flux changes in a manner which is indicative of the sabot release.

21. The method of claim 20, further comprising the step of sensing the change in magnetic flux with a second sensing means being arranged and configured so as to form a gradiometer device with respect to said first sensing means, whereby only removal of the magnet upon a firing of the projectile is detected.

* * * * *